US006319970B1

(12) United States Patent
Shin et al.

(10) Patent No.: US 6,319,970 B1
(45) Date of Patent: Nov. 20, 2001

(54) FLASH SPINNING PROCESS AND FLASH SPINNING SOLUTION WITH AZEOTROPES

(75) Inventors: Hyunkook Shin, Wilmington; Roger Keith Siemionko, Hockessin, both of DE (US); Nanlin Deng, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/675,968

(22) Filed: Sep. 29, 2000

Related U.S. Application Data

(62) Division of application No. 09/211,822, filed on Dec. 15, 1998, now Pat. No. 6,153,134.

(51) Int. Cl.[7] ..... C08K 5/06; C08K 5/02

(52) U.S. Cl. ..... 524/366; 524/462; 524/464

(58) Field of Search ..... 524/366, 462, 524/464

(56) References Cited

U.S. PATENT DOCUMENTS

| | | | |
|---|---|---|---|
| 3,851,023 | 11/1974 | Brethauer et al. | 264/24 |
| 5,023,025 | 6/1991 | Shin | 264/13 |
| 5,032,326 | 7/1991 | Shin | 264/13 |
| 5,147,586 | 9/1992 | Shin et al. | 264/13 |
| 5,286,422 | 2/1994 | Kato et al. | 264/13 |
| 5,672,307 | 9/1997 | Shin et al. | 264/205 |

FOREIGN PATENT DOCUMENTS

| | | | |
|---|---|---|---|
| 0526310-A | 10/1993 | (JP) | D01F/6/04 |
| WO 97/41189 | 11/1997 | (WO) | C09K/5/04 |
| WO 96/36689 | 11/1996 | (WO) | C11D/7/50 |
| WO 97/25460 | 7/1997 | (WO) | D01D/5/11 |
| WO 97/25461 | 7/1997 | (WO) | D01D/5/11 |
| WO 97/33016 | 9/1997 | (WO) | D01D/5/11 |

*Primary Examiner*—Peter D. Mulcahy

(57) ABSTRACT

A spinning process using azeotropic compounds as spin agents having essentially zero ozone depletion potential and that are either non-flammable or of very low flammability.

5 Claims, 6 Drawing Sheets

P11589-42,93,94,125

P11589-42,93,94,125

P11752-61

FLASH SPINNING PROCESS AND FLASH SPINNING SOLUTION WITH AZEOTROPES

This is a division of application Ser. No. 09/211,822 filed Dec. 15, 1998, now U.S. Pat. No. 6,153,134.

FIELD OF THE INVENTION

This invention relates to flash-spinning of polymeric, plexifilamentary, film-fibril strands in which the spinning process utilizes compounds having essentially zero ozone depletion potential and in which the spinning process is carried out utilizing compounds that are either non-flammable or of very low flammability.

BACKGROUND OF THE INVENTION

Commercial spunbonded products made from polyethylene plexifilamentary film-fibril strands have typically been produced by flash-spinning from trichlorofluoromethane; however, trichlorofluoromethane is an atmospheric ozone depletion chemical, and therefore, alternatives have been under investigation. U.S. Pat. No. 5,032,326 to Shin discloses one alternative spin fluid, namely, methylene chloride and a co-spin agent halocarbon having a boiling point between −50° C. and 0° C. As pointed out in Kato et al. U.S. Pat. No. 5,286,422, the Shin methylene chloride-based process is not entirely satisfactory, and the '422 patent discloses an alternative, specifically, a spin fluid of bromochloromethane or 1,2-dichloroethylene and a co-spin agent of, e.g., carbon dioxide, dodecafluoropentane, etc.

Published Japanese Application J05263310-A (published Oct. 12, 1993) discloses that three-dimensional fiber favorable for manufacturing flash-spun non-woven sheet may be made from polymer dissolved in mixtures of spin agents where the major component of the spin agent mixture is selected from the group consisting of methylene chloride, dichloroethylene, and bromochloromethane, and the minor component of the spin agent mixture is selected from the group consisting of dodecafluoropentane, decafluoropentane, and tetradecafluorohexane. However, it is known, for example, that methylene chloride is an animal carcinogen and dichloroethylene is somewhat flammable.

U.S. Pat. No. 5,023,025 to Shin discloses a process for flash-spinning plexifilamentary film-fibril strands of fiber-forming polyolefin from a group of halocarbon liquids that present a greatly reduced ozone depletion hazard. The patent discloses 1,1-dichloro-2,2,2-trifluoroethane (HCFC-123) as a preferred halocarbon (halogenated hydrocarbon). HCFC-123 is a very good spin agent for polypropylene but not for polyethylene, and in the latter case a very high spinning pressure would be required. As such, for use with polyethylene, a co-spin agent has to be employed that is capable of dissolving polyethylene at relatively low pressures (i.e., a strong solvent). The '025 patent also discloses dichlorodifluoroethane (HCFC-132b and its isomers) and dichlorofluoroethane (HCFC-141b and its isomers), all of which have significant disadvantages. For example, HCFC-132b is a good spin agent, but toxic. HCFC-141b is also a good spin agent, but somewhat flammable, and moreover exhibits a relatively high ozone depletion potential. However, regardless of any of their apparent advantages, the aforementioned spin agents all exhibit some amount of ozone depletion potential.

Flashspun products have typically been made from polyethylene. However, it is known that both polypropylene and polymethylpentene have higher melting points than does polyethylene and as such provide a flashspun product usable at higher temperatures when compared to product made from polyethylene. Moreover, certain solvents may dissolve polypropylene or polymethylpentene, but not polyethylene, therefore motivation exists to find solvents that are particularly suited to polypropylene and polymethylpentene and yet satisfy the need for non-flammability and zero or extremely low ozone depletion potential.

SUMMARY OF THE INVENTION

The present invention is a process for the preparation of plexifilamentary film-fibril strands of synthetic fiber-forming polyolefin which comprises flash-spinning at a pressure that is greater than the autogenous pressure of the spin fluid into a region of lower pressure, a spin fluid comprising (a) 5 to 30 wgt. % synthetic fiber-forming polyolefin, and (b) a spin agent selected from the group consisting of a mixture of about 46 wgt. % decafluoropentane, about 40 wgt. % trans-1,2 dichloroethylene and about 14 wgt. % cyclopentane; and a mixture of about 50 wgt. % perfluorobutyl methyl ether and about 50 wgt. % trans-1,2-dichloroethylene.

This invention is also a spin fluid comprising (a) 5 to 30 wgt. % synthetic fiber-forming polyolefin, and (b) a spin agent selected from the group consisting of a mixture of about 46 wgt. % decafluoropentane, about 40 wgt. % trans-1,2 dichloroethylene and about 14 wgt. % cyclopentane; and a mixture of about 50 wgt. % perfluorobutyl methyl ether and about 50 wgt. % trans-1,2-dichloroethylene.

This invention is also directed to a process for the preparation of microcellular foam fibers from synthetic fiber-forming polyolefin which comprises flash-spinning at a pressure that is greater than the autogenous pressure of the spin fluid into a region of lower pressure, a spin fluid comprising (a) at least 40 wgt. % synthetic fiber-forming polyolefin, and (b) a spin agent selected from the group consisting of a mixture of about 46 wgt. % decafluoropentane, about 40 wgt. % trans-1,2 dichloroethylene and about 14 wgt. % cyclopentane; and a mixture of about 50 wgt. % perfluorobutyl methyl ether and about 50 wgt. % trans-1,2-dichloroethylene.

BRIEF DESCRIPTION OF THE DRAWINGS

The accompanying drawings, together with the description, serve to explain the principles of the invention.

DETAILED DESCRIPTION OF THE INVENTION

Figure 1:
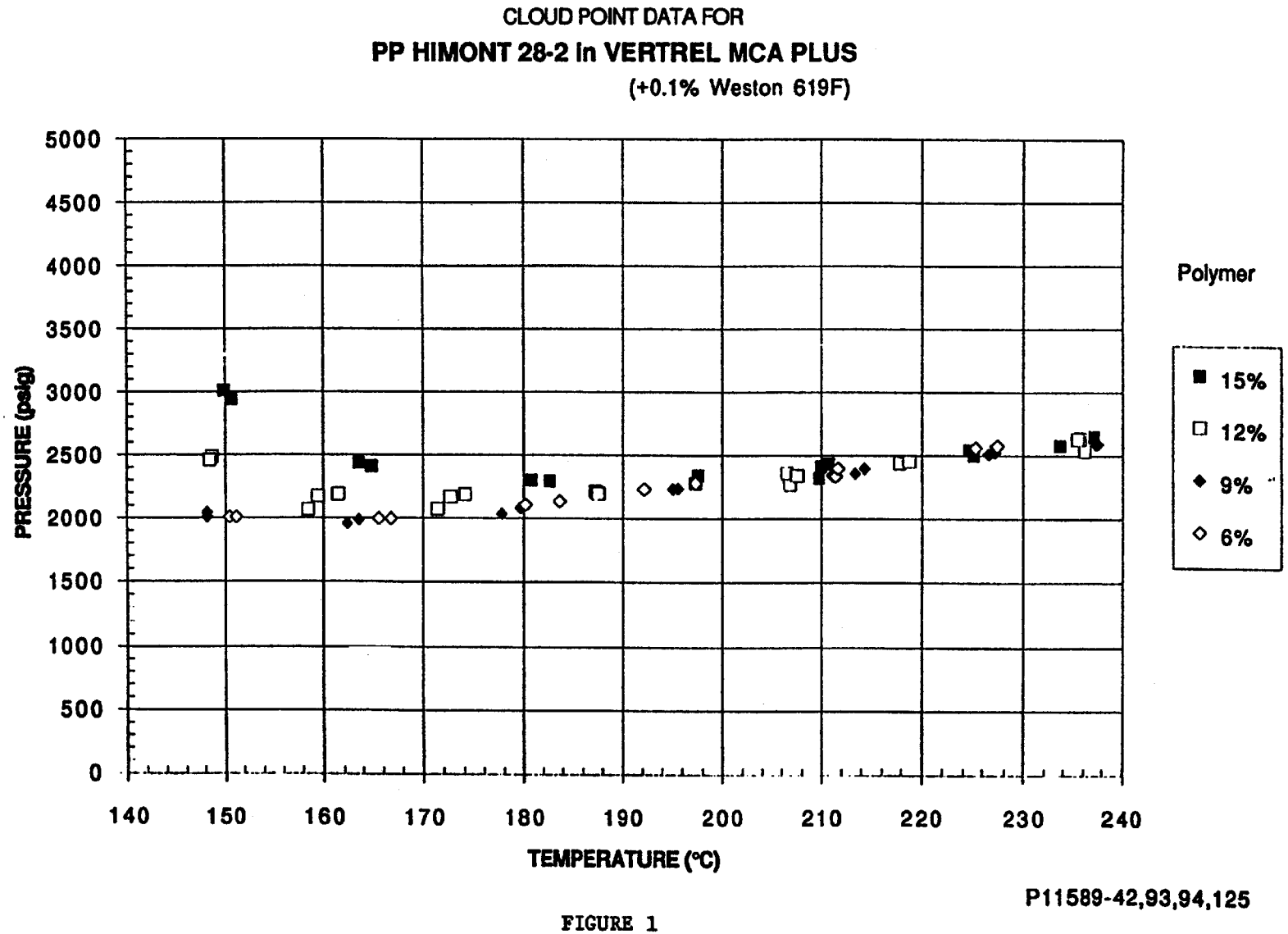
FIG. 1 is a plot of the cloud point data for a solution of polypropylene at various weight percentages in a spin agent of VERTREL® MCA PLUS.
Figure 2:
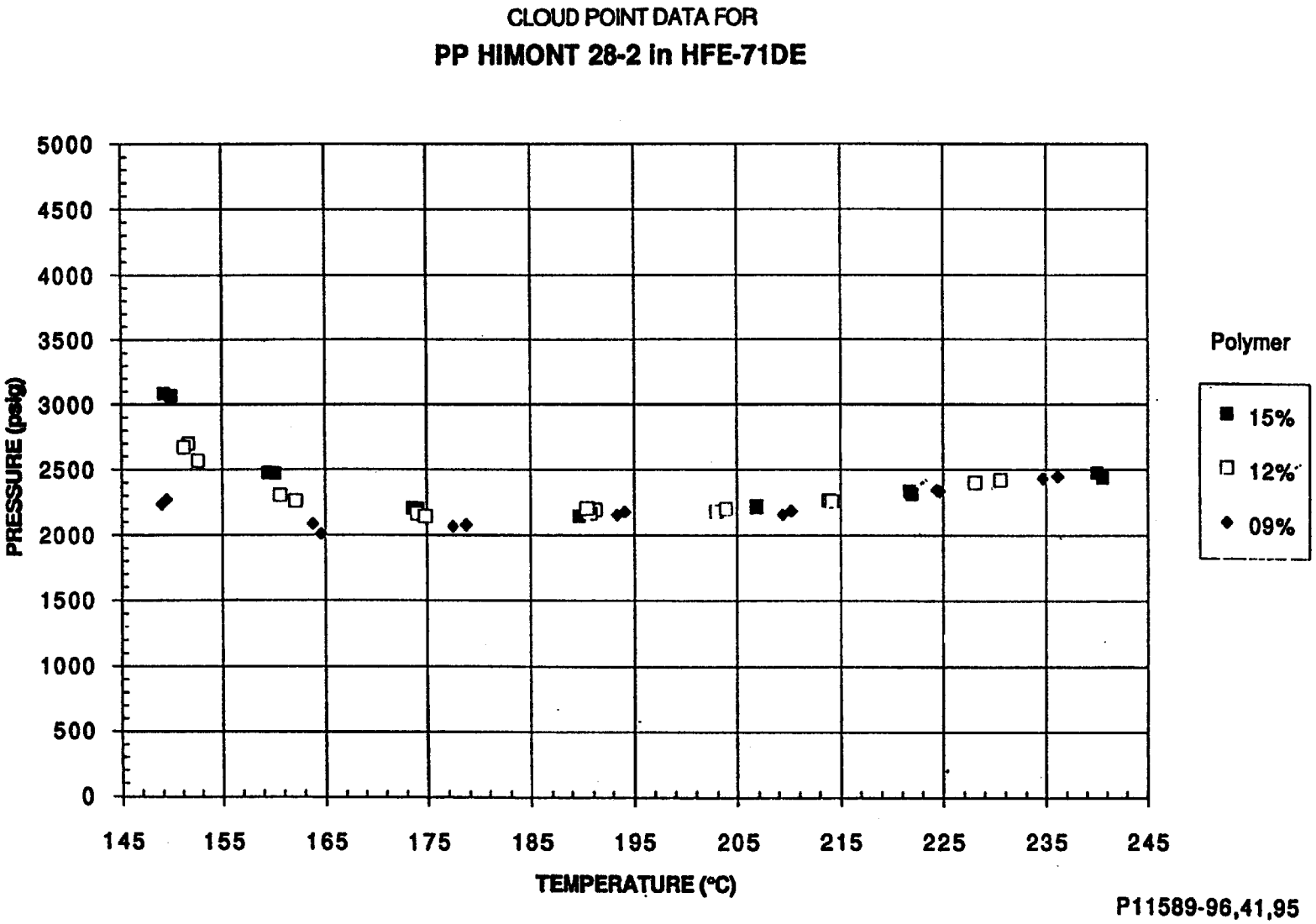
FIG. 2 is a plot of the cloud point data for a solution of polypropylene at various weight percentages in a spin agent of HFE-71DE.
Figure 3:
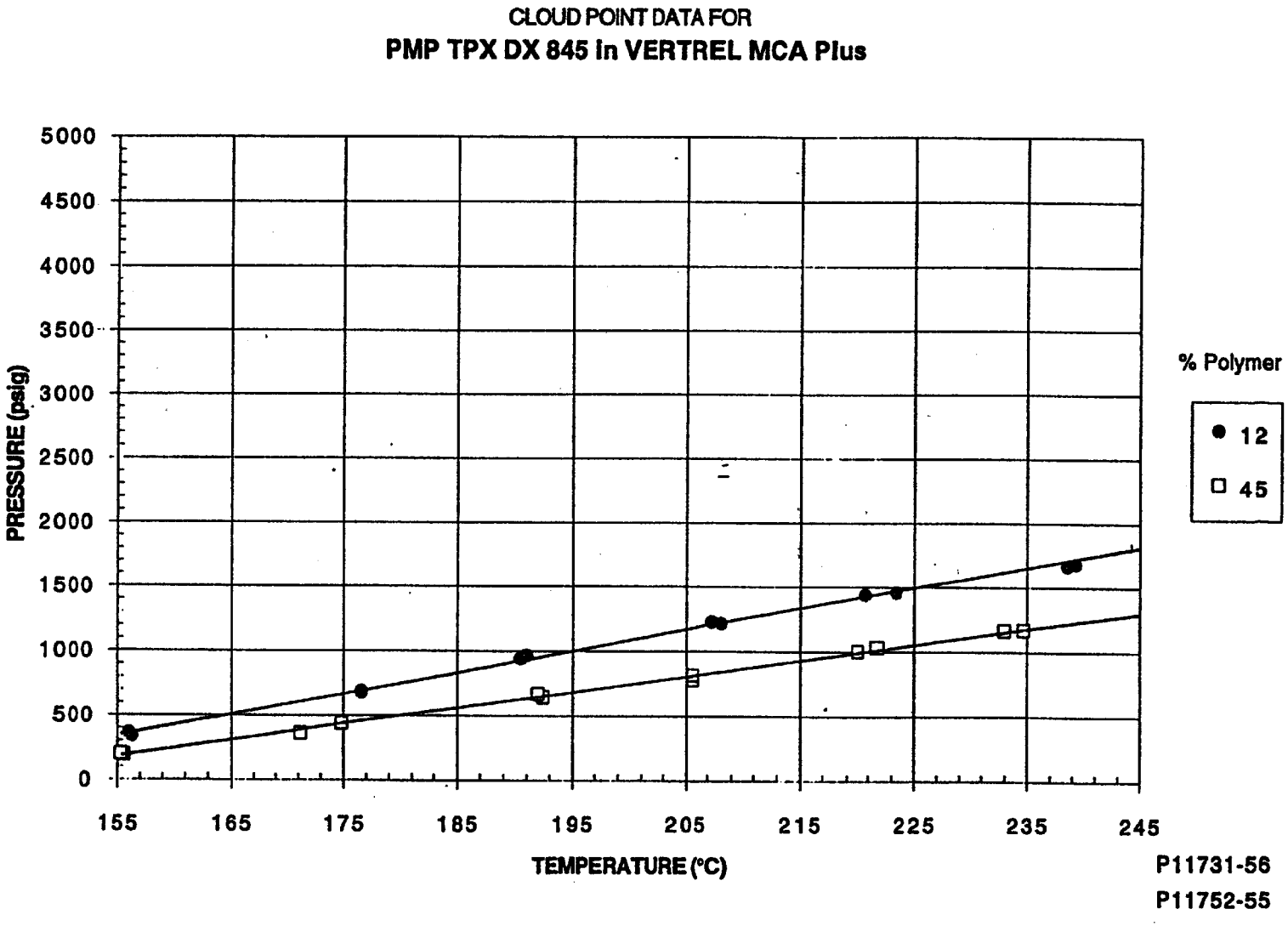
FIG. 3 is a plot of the cloud point data for a solution of polymethylpentene at various weight percentages in a spin agent of VERTREL® MCA PLUS.
Figure 4:
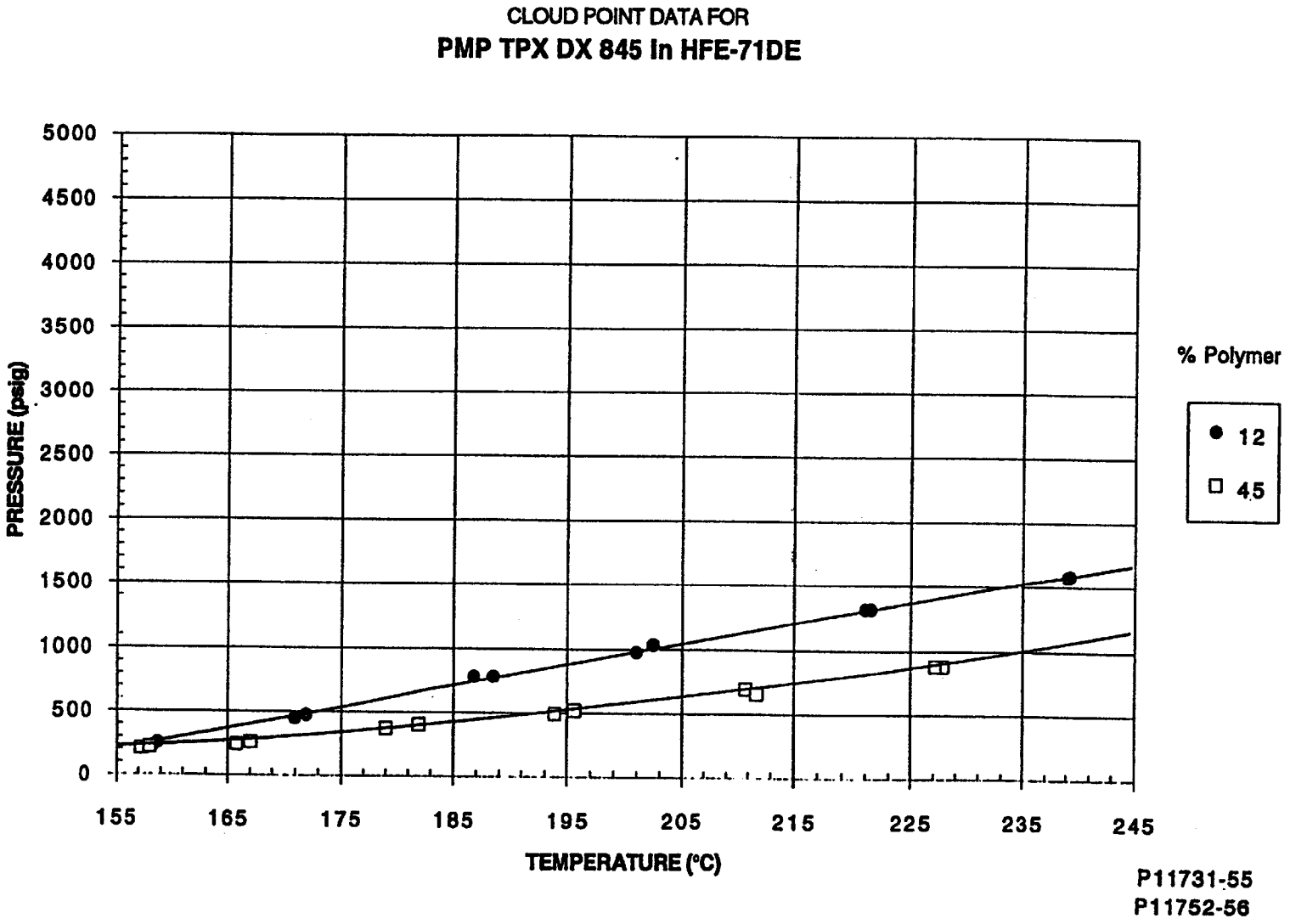
FIG. 4 is a plot of the cloud point data for a solution of polymethylpentene at various weight percentages in a spin agent of HFE-71DE.
Figure 5:
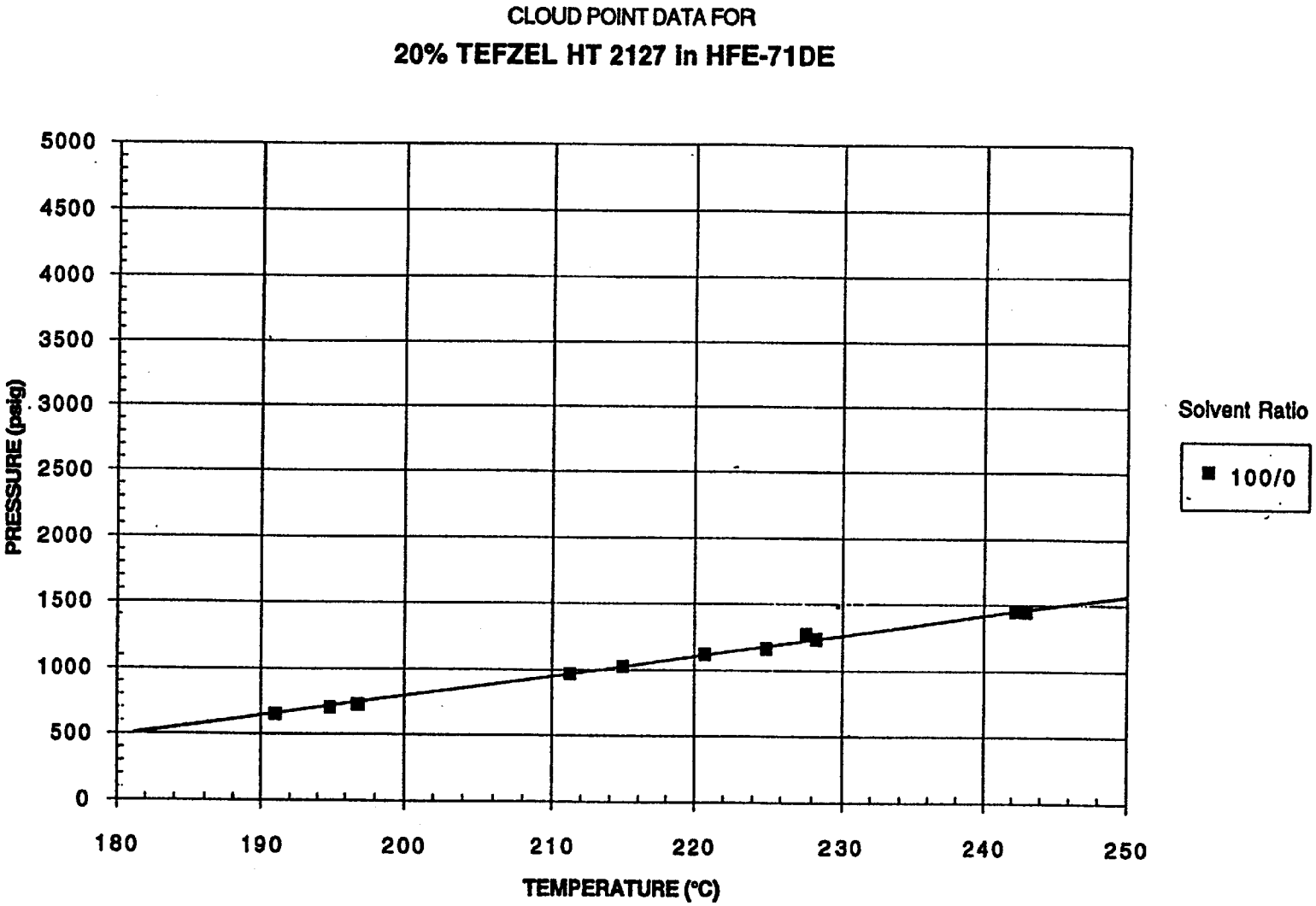
FIG. 5 is a plot of the cloud point data for a solution of TEFZEL at 20% by weight in a spin agent of HFE-71DE.
Figure 6:
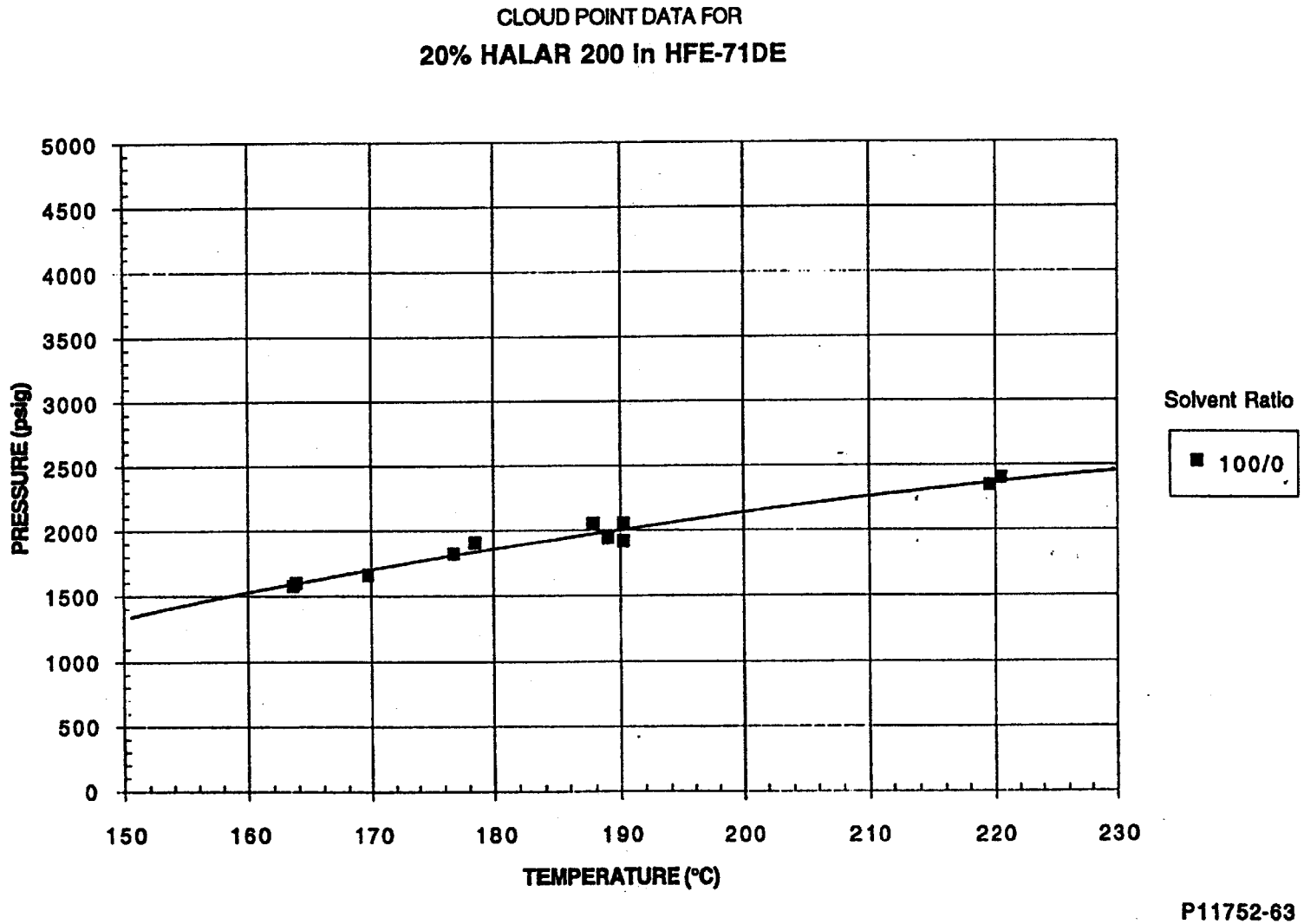
FIG. 6 is a plot of the cloud point data for a solution of HALAR at 20% by weight in a spin agent of HFE-71DE.

The term "synthetic fiber-forming polyolefin" is intended to encompass certain polymers typically used in the flash-spinning art, e.g., polypropylene, and polymethylpentene. A preferred synthetic fiber-forming polyolefin is isotactic polypropylene.

The term "polypropylene" is intended to embrace not only homopolymers of propylene but also copolymers where at least 85% of the recurring units are propylene units. The term "polymethylpentene" is intended to embrace not only homopolymers of polymethylpentene but also copolymers where at least 85% of the recurring units are methylpentene units.

The preferred process for making plexifilamentary materials employs a spin fluid in which the synthetic fiber-forming polyolefin concentration is in the range of 6 to 18 wgt. % of the spin fluid. The term spin fluid as used herein means the solution comprising the fiber-forming polyolefin and the spin agent. Unless noted otherwise the term wgt. % as used herein refers to the percentage by weight based on the total weight of the spin fluid.

Also, for the subject invention, the folloowing may be used as fiber-forming materials: TEFZEL®, a fluoropolymer obtained from DuPont, which is a copolymer of ethylene and tetrafluoroethylene and HALAR®, a fluoropolymer resin obtained from Ausimont, which is a copolymer of ethylene and chlorotrifluoroethylene. The copolymers can be present in an amount of 10 to 40 wgt. %.

A spin agent of the subject invention is VERTREL® MCA PLUS, an azeotrope consisting of a mixture of about 46 wgt. % 2,3-dihydrodecafluoropentane (HFC-4310mee), about 40 wgt. % trans-1,2 dichloroethylene and about 14 wgt. % cyclopentane, (hereafter MCA), available from E.I. du Pont de Nemours and Company, Wilmington, Del. (DuPont). Another spin agent of the subject invention is HFE-71DE, an azeotrope consisting of a mixture of about 50 wgt. % perfluorobutyl methyl ether and about 50 wgt. % trans-1,2-dichloroethylene, (hereafter 71DE) available from Minnesota Mining and Manufacturing Company, St. Paul, Minn. (3M). MCA has extremely low flammability, that is, MCA has no flash point, but does have upper and lower flammability limits (3–10 volume percent in air). On the other hand, 71DE is non-flammable, that is, 71DE has neither a flash point nor flammability limits. It is desirable that the spin agents should be non-flammable or have very low flammability. It should be noted that these azeotropes may contain some portion of cis-1,2-dichloroethylene. The spin agents of this invention will not change in composition when they are spilled because they are azeotropes. Non-azeotropic spin agents based on trans-1,2 dichloroethylene may become flammable under certain conditions. For example, if a non-azeotropic spin agent were spilled, the volatile components would evaporate and leave the non-volatile component in a concentrated form and if it were flammable, it would provide a risk of fire. In such situations, special solvent handling systems would be required to avoid a potential safety hazard.

The term azeotrope as used herein is meant to include azeotrope-like materials that may have a composition that is slightly different from the pure azeotropic composition.

The term "cloud-point pressure" as used herein, means the pressure at which a single phase liquid solution starts to phase separate into a polymer-rich/spin liquid-rich two-phase liquid/liquid dispersion. However, at temperatures above the critical point, there cannot be any liquid phase present and therefore a single phase supercritical solution phase separates into a polymer-rich/spin fluid-rich, two-phase gaseous dispersion.

In order to spread the web formed when polymers are flash spun in the commercial operations, the flash spun material is projected against a rotating baffle: see, for example, Brethauer et al. U.S. Pat. No. 3,851,023, and then subjected to an electrostatic charge. The baffle causes the product to change directions and start to spread, and the electrostatic charge causes the product (web) to further spread. In order to achieve a satisfactory commercial product in a commercially acceptable time, it is necessary that the web achieve a significant degree of spread, and this can be achieved only if sufficient electrostatic charge remains on the web for the desired time. The charge will dissipate too rapidly if the atmosphere surrounding the web has too low a dielectric strength. A major component of the atmosphere surrounding the web is the vaporized spin agents that, prior to flash spinning, dissolved the polymer which was flash spun. As disclosed in U.S. Pat. No. 5,672,307, primary spin agents such as methylene chloride or 1,2-dichloroethylene, with co-spin agents as listed therein, have a dielectric strength, when vaporized, sufficient to maintain an effective electric charge on the web to insure a satisfactory product. These mixtures have a dielectric strength as measured by ASTM D-2477 of greater than about 40 kilovolts per centimeter (KV/cm). The spin agents of the subject invention, however, have a much higher dielectric strength than methylene chloride and approaches that of trichlorofluoromethane (Freon 11). Some typical values are as follows:

| Compound | Dielectric Strength (KV/cm) |
|---|---|
| Methylene Chloride | ~45 |
| Dichloroethylene | ~105 |
| HCFC-122 | ~120 |
| Freon 11 | ~120 |
| Decafluoropentane | ~120 |
| Cyclopentane | ~50 |
| Perfluorobutyl methyl ether | >100 |

Dielectric strengths for the constituents of the inventive azeotropes are presented above and it would be expected that the dielectric strength of the azeotropes would be greater than that of methylene chloride, as an example. Higher dielectric strength is desirable because it favors higher production rates in that the plexifilamentary material "pins" better to the fast-moving, electrically-charged belt due to electrostatic attraction. The spin fluid may further contain additives such as nucleating agents, stabilizers and the like.

Microcellular foams can be obtained by flash-spinning and are usually prepared at relatively high polymer concentrations in the spinning solution i.e., at least 40 wgt. % synthetic fiber-forming polyolefin. Polypropylene, and polymethylpentene are the synthetic fiber-forming polyolefins that can be used. However, as noted above for the plexifilamentary fibers, TEFZEL® and HALAR® can also be used to obtain microcellular foams. In the case of foams the copolymers would be used at the same wgt. % as polypropylene, and polymethylpentene, i.e., at least 40 wgt. %. Also, relatively low spinning temperatures and pressures that are above the cloud point pressure are used. Microcellular foam fibers may be obtained rather than plexifilaments, even at spinning pressures slightly below the cloud point pressure of the solution. Spin agents used are the same as those noted above for plexifilamentary, film-fibril materials. Nucleating agents, such as fumed silica and kaolin, are usually added to the spin mix to facilitate spin agent flashing and to obtain uniform small size cells.

Microcellular foams can be obtained in a collapsed form or in a fully or partially inflated form. For many polymer/solvent systems, microcellular foams tend to collapse after exiting the spinning orifice as the solvent vapor condenses inside the cells and/or diffuses out of the cells. To obtain low density inflated foams, inflating agents are usually added to the spin liquid. Suitable inflating agents that can be used include low boiling temperature partially halogenated hydrocarbons, such as, hydrochlorofluorocarbons and hydrofluorocarbons; or fully halogenated hydrocarbons, such as chlorofluorocarbons and perfluorocarbons; hydrofluoroethers; inert gases such as carbon dioxide and nitrogen; low boiling temperature hydrocarbon solvents such as butane and isopentane; and other low boiling temperature organic solvents and gases.

Microcellular foam fibers are normally spun from a round cross section spin orifice. However, annular dies similar to the ones used for blown films can be used to make microcellular foam sheets.

EXAMPLES

Test Methods

In the description above and in the non-limiting examples that follow, the following test methods were employed to determine various reported characteristics and properties. ASTM refers to the American Society of Testing Materials, and TAPPI refers to the Technical Association of the Pulp and Paper Industry.

The denier of the strand is determined from the weight of a 15 cm sample length of strand under a predetermined load.

Tenacity, elongation and toughness of the flash-spun strand are determined with an Instron tensile-testing machine. The strands are conditioned and tested at 70° F. (21° C.) and 65% relative humidity. The strands are then twisted to 10 turns per inch and mounted in the jaws of the Instron Tester. A two-inch gauge length was used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem. Soc., V. 60 p 309–319 (1938) and is reported as $m^2/g$.

Test Apparatus for Examples 1–23

The apparatus used in the examples 1–23 is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3⁄32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with a length and a diameter each measuring 30 mils (0.762 mm). The pistons are driven by high pressure water supplied by a hydraulic system.

In the tests reported in Examples 1–23, the apparatus described above was charged with pellets of a polyolefin and a spin agent. High pressure water was used to drive the pistons to generate a mixing pressure of between 1500 and 3000 psig (10,170–20,340 kPa). The polymer and spin agent were next heated to mixing temperature and held at that temperature a specified period of time during which the pistons were used to alternately establish a differential pressure of about 50 psi (345 kPa) or higher between the two cylinders so as to repeatedly force the polymer and spin agent through the mixing channel from one cylinder to the other to provide mixing and to effect formation of a spin mixture. The spin mixture temperature was then raised to the final spin temperature, and held there for about 15 minutes or longer to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice was opened about one to three seconds after the opening of the valve between the spin cell and the accumulator. This period roughly corresponds to the residence time in the letdown chamber of a commercial spinning apparatus. The resultant flash-spun product was collected in a stainless steel open mesh screen basket. The pressure recorded just before the spinneret using a computer during spinning was entered as the spin pressure.

The experimental conditions and the results for Examples 1–23 are given below in Tables 1–4. All the test data not originally obtained in the SI system of units has been converted to the SI units. When an item of data was not measured, it is noted in the tables as nm.

Examples 1–8

In Examples 1–8, samples of isotactic polypropylene with relatively narrow molecular weight distribution (MWD) obtained from Montell (previously known as Himont) of Wilmington, Del. were used at various concentrations. The azeotropes MCA and 71DE were used as the spin agents. The polypropylene had a melt flow rate (MFR) of 1.5, a number average molecular weight of 80,200, a weight average molecular weight of 349,000. The MWD is the ratio of weight average molecular weight to number average molecular weight and was 4.4.

Weston 619F, a diphosphite thermal stabilizer from GE Specialty Chemicals, was added at 0.1 wgt. % based on the total weight of the spin agent.

TABLE 1

| | | | MIXING | | | | SPINNING | | | PROPERTIES @ 10 tpi | | | | | | |
|---|---|---|---|---|---|---|---|---|---|---|---|---|---|---|---|---|
| Sample | Polymer Conc Wt. % | SOLVENT Type | ° C. | Min | Back psig | ΔP | ACCUM. Psig | SPIN psig | ° C. | gms load | Den | Mod gpd | Ten gpd | To gpd | E % | BET SA |
| 1 | 8 | 71DE | 190 | 30 | 3000 | 600 | 1950 | 1775 | 190 | 40 | 257 | 4.5 | 1.48 | 1.64 | 154 | 6.4 |
| 2 | 10 | 71DE | 190 | 30 | 3000 | 600 | 1950 | 1800 | 190 | 40 | 323 | 4.2 | 1.33 | 1.27 | 139 | 5.8 |
| 3 | 10 | 71DE | 200 | 30 | 3000 | 600 | 1950 | 1800 | 199 | 40 | 235 | 4.5 | 1.49 | 1.54 | 142 | 7.8 |
| 4 | 9 | MCA | 190 | 30 | 2800 | 200 | 2100 | 2000 | 190 | 40 | 194 | 3.1 | 1.43 | 1.01 | 108 | 10.2 |
| 5 | 12 | MCA | 190 | 30 | 2800 | 200 | 2000 | 1850 | 190 | 40 | 315 | 2.2 | 2.27 | 1.49 | 101 | 8.3 |

TABLE 1-continued

| | | | MIXING | | | | SPINNING | | | PROPERTIES @ 10 tpi | | | | | | |
|---|---|---|---|---|---|---|---|---|---|---|---|---|---|---|---|---|
| Sample | Polymer Conc Wt. % | SOLVENT Type | ° C. | Min | Back psig | ΔP | ACCUM. Psig | SPIN psig | ° C. | gms load | Den | Mod gpd | Ten gpd | To gpd | E % | BET SA |
| 6 | 12 | MCA | 190 | 30 | 2800 | 200 | 1900 | 1800 | 190 | 40 | 301 | 1.9 | 1.84 | 0.92 | 89 | 7.7 |
| 7 | 12 | MCA | 200 | 30 | 2800 | 200 | 2050 | 1925 | 200 | 40 | 313 | 1.9 | 1.48 | 0.97 | 104 | 7.2 |
| 8 | 12 | MCA | 200 | 30 | 2800 | 200 | 2050 | 1950 | 200 | 40 | 285 | 3.0 | 1.62 | 1.15 | 114 | nm |

Examples 9–14

In Examples 9–14, samples of Mitsui DX 845 polymethylpentene were obtained from Mitsui Plastics, Inc. (White Plains, N.Y.). The azeotropes MCA and 71DE were used as the spin agents. The polymethylpentene was used at various concentrations.

Weston 619F, a diphosphite thermal stabilizer from GE Specialty Chemicals, was added at 0.1 wgt. % based on the total weight of the spin agent.

Example 23

A sample of fluoropolymer, HALAR® 200 which is an ethylene/chlorotrifluoroethylene copolymer available from Ausimont, was flashspun using a spin fluid comprising a spin agent of 71DE. The fluoropolymer was present at 20 wgt. % of the spin fluid. HALAR® 200 has a melt index of 0.7 and a melting point of 240° C. Weston 619F, a diphosphite thermal stabilizer from GE Specialty Chemicals, was added at 0.1 wgt. % based on the total weight of the spin agent.

TABLE 2

| | POLYMER | | MIXING | | | | SPINNIN6 | | | PROPERTIES @ 10 tpi | | | | | |
|---|---|---|---|---|---|---|---|---|---|---|---|---|---|---|---|
| Sample | Polymer Tot. Wt. % | SOLVENT Type | ° C. | Min | Back psig | ΔP | ACCUM. psig | SPIN psig | T ° C. | gms load | Den | Mod gpd | Ten gpd | E % | BET SA |
| 9 | 12 | 71DE | 140–240 | 30 | 2500 | 200 | 1400 | 1325 | 240 | 50 | 183 | 5.8 | 1.62 | 44 | 19.4 |
| 10 | 12 | 71DE | 140–250 | 22 | 2500 | 200 | 1550 | 1475 | 252 | 20 | 185 | 2 | 0.83 | 45 | 13 |
| 11 | 12 | MCA | 140–240 | 27 | 2500 | 250 | 1500 | 1400 | 241 | 10 | 237 | 1.5 | 0.73 | 45 | 15.4 |
| 12 | 12 | MCA | 140–150 | 23 | 2500 | 200 | 1650 | 1550 | 251 | 10 | 226 | 1.6 | 0.7 | 40 | nm |
| 13 | 16 | MCA | 140–140 | 29 | 2500 | 200 | 1450 | 1350 | 241 | 20 | 311 | 2.6 | 0.75 | 41 | 15 |
| 14 | 20 | MCA | 140–140 | 24 | 2500 | 250 | 1400 | 1300 | 241 | 50 | 322 | 4.2 | 1.2 | 47 | 16.7 |

Examples 15–22

Samples of TEFZEL® HT2127 which is an ethylene/tetraflouroethylene copolymer available from DuPont were flashspun using the azeotropes MCA and 71DE as spin agents. The copolymer was present at 20 wgt. % of the spin fluid. Copolymers of this type have melting points between 235° C. and 280° C.

TABLE 3

| | | | MIXING | | | | SPINNING | | | | PROPERTIES @ 10 tpi | | | | | |
|---|---|---|---|---|---|---|---|---|---|---|---|---|---|---|---|---|
| Sample | POLYMER Type | SOLVENT Type | ° C. | Min | Back psig | ΔP | ACCUM. psig | SPIN psig | ° C. | secs | gms load | Den | Mod gpd | Ten gpd | E % | BET SA |
| 15 | HT2127 | 71DE | 230 | 30 | 2200 | 200 | 1050 | 950 | 230 | 1 | 50 | 263 | 6.4 | 1.92 | 28 | 26 |
| 16 | HT2127 | 71DE | 220 | 30 | 2200 | 200 | 900 | 800 | 220 | 1 | 50 | 289 | 6.22 | 2.02 | 30 | 17 |
| 17 | HT2127 | 71DE | 210 | 35 | 2200 | 200 | 750 | 625 | 210 | 1 | 50 | 353 | 5.33 | 1.81 | 27 | 24 |
| 18 | HT2127 | 71DE | 200 | 30 | 2200 | 200 | 600 | 500 | 200 | 1 | 100 | 423 | 6.5 | 1.78 | 26 | nm |
| 19 | HT2127 | MCA | 230 | 30 | 2200 | 200 | 1150 | 1050 | 230 | 1 | 50 | 267 | 5.7 | 2.06 | 30 | 27 |
| 20 | HT2127 | MCA | 220 | 30 | 2200 | 200 | 1000 | 900 | 221 | 1 | 40 | 291 | 5.5 | 1.75 | 28 | 29 |
| 21 | HT2127 | MCA | 210 | 30 | 2200 | 200 | 850 | 750 | 210 | 1 | 40 | 349 | 4.9 | 1.49 | 24 | 27 |
| 22 | HT2127 | MCA | 200 | 30 | 2200 | 200 | 700 | 600 | 201 | 1 | 50 | 365 | 4.9 | 1.43 | 22 | 28 |

TABLE 4

| | MIXING | | | | SPINNING | | | PROPERTIES @ 10 tpi | | | | | |
|---|---|---|---|---|---|---|---|---|---|---|---|---|---|
| Sample | ° C. | Min | Back psig | ΔP | ACCUM. Psig | SPIN psig | ° C. | gms load | Den | Mod gpd | Ten gpd | To gpd | E % |
| 23 | 230 | 30 | 3000 | 200 | 2300 | 2100 | 230 | 50 | 589 | 9.9 | 1.82 | 0.26 | 29.2 |

Example 24

Samples of Mitsui DX 845 polymethylpentene from Mitsui Plastics Inc. (White Plains, N.Y.) were flashspun in a spin agent of either MCA or 71DE. The polymethylpentene was present at 50 wgt. % of the spin fluid. Mixing was done at 150 C for 45 min at 1500 psig (10,170 kPa). The differential pressure was 1000 psi (6996 kPa). Spinning took place at a 840 psig (5690 kPa) accumulator pressure with the spinning being done at 350 psig (2310 kPa) at 151 C.

Acceptable microcellular foam was obtained.

What is claimed is:

1. A spin fluid comprising (a) 5 to 30 wgt. % synthetic fiber-forming polyolefin and (b) a spin agent selected from the group consisting of a mixture of about 46 wgt. % decafluoropentane, about 40 wgt. % trans-1,2 dichloroethylene and 14 wgt. % cyclopentane; and a mixture of about 50 wgt. % perfluorobutyl methyl ether and about 50 wgt. % trans-1,2-dichloroethylene.

2. The spin fluid of claim 1, wherein the synthetic fiber-forming polyolefin is selected from the group consisting of polypropylene and polymethylpentene.

3. The spin fluid of claim 1, wherein the polypropylene is present in an amount of 6 to 15 wgt. %.

4. The spin fluid of claim 1, wherein the polymethylpentene is present in an amount of 8 to 20 wgt. %.

5. The spin fluid of claim 1, wherein the synthetic fiber-forming polyolefin is selected from the group consisting of a partially fluorinated copolymer of ethylene and tetrafluoroethylene and a partially fluorinated copolymer of ethylene and chlorotrifluoroethylene with the proviso that the copolymers are present in an amount of 10 to 40 wgt. %.

* * * * *